US006273578B1

(12) United States Patent
Lai

(10) Patent No.: US 6,273,578 B1
(45) Date of Patent: Aug. 14, 2001

(54) ILLUMINATED MULTIPLE ELECTRICAL OUTLET STRIP WITH PULL-OUT HANDLE FOR OUTDOOR USE

(76) Inventor: Li-Chun Lai, 21F-1, No. 33, Sec. 1, Min Sheng Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 09/457,483

(22) Filed: Dec. 9, 1999

(51) Int. Cl.[7] ..... F21V 33/00

(52) U.S. Cl. ..... 362/95; 362/276; 362/368; 362/431; 362/253; 362/458; 439/93; 361/643; 361/658; 174/58

(58) Field of Search ..... 362/95, 227, 257, 362/368, 457, 458; 220/3.2, 3.3, 3.9; 248/906, 511, 530, 533; 439/211, 93, 894, 925, 940; 307/43, 80; 361/601, 641, 643, 658; 174/52.1, 53, 58; 262/368, 362, 431, 802, 276, 253

(56) References Cited

U.S. PATENT DOCUMENTS 2,219,650 * 10/1940 Stewart ..... 439/650
4,113,334 * 9/1978 Instone ..... 439/96
4,343,032 * 8/1982 Schwartz ..... 362/276
4,493,515 * 1/1985 Banks ..... 439/97
4,717,350 * 1/1988 Lax ..... 439/92
5,003,441 * 3/1991 Crowe et al. ..... 362/183
5,062,028 * 10/1991 Frost et al. ..... 362/183
5,065,291 * 11/1991 Frost et al. ..... 362/183
5,708,554 * 1/1998 Liner ..... 361/104

* cited by examiner

*Primary Examiner*—Thomas M. Sember
*Assistant Examiner*—Ismael Negron
(74) *Attorney, Agent, or Firm*—Bacon & Thomas, PLLC

(57) ABSTRACT

A socket stand for outdoor use includes a plurality of individual sockets provided with shielding covers and a conical sustainer for permitting the stand to be removably mounted on the ground. The stand also includes a pull lever and photo emission equipment for night work. Electric hazard is prevented by a water tight construction and isolation of the user from direct contact with the live electrical parts.

7 Claims, 4 Drawing Sheets

ILLUMINATED MULTIPLE ELECTRICAL OUTLET STRIP WITH PULL-OUT HANDLE FOR OUTDOOR USE

BACKGROUND OF THE INVENTION

1. Field of the Invention

The invention relates to a Removable socket stand for extension wires for use in outdoor garden and lawn, wherein a conical sustainer is provided at the bottom of the main body of the socket stand so as to temporally fix the socket stand on the ground of garden and lawn, and a plurality of elements for ensuring electrical security and lighting in the dark are also provided thereof 2. Description of the Prior Art As it can be used to supplement inadequate installation of sockets in a residence, factory, or the like, a removable socket stand for extension wires is widely employable. It is really convenient for a socket or sockets to be removable here and there, indoor or outdoor in any desired places where electric power is required. But there arises a problem that electrical security can not be ensured as the socket stand is removed by pulling the extension wires around outdoor wet or muddy environments in stead of installing it firmly and securely on the safety place. As a result, there have been too many deplorable accidental cases arisen from careless handling of such removable socket stands by ordinary citizens.

In order to solve the problems inherent to the conventional technique described above, researches and developments have been carried out for a long time, and finally the inventor comes to realization of the present invention which will now be disclosed hereinafter.

SUMMARY OF THE INVENTION

It is an object of the present invention to provide a removable socket stand for extension wires which can be sustained on the ground with a proper height thereabove to keep away from the puddles of the saturated field such that the user may securely use electricity without the fear of being electrocuted.

It is another object of the present invention to provide a removable socket stand for extension wires having an insulated transparent cover to protect a main switch of the socket stand so as to ensure water tightness of the main switch and protect the user's safety. In addition, a shielded cover is also provided for individual sockets so that the Sockets can be shielded in case they are not in use thereby protecting possible injury to a third person who touches them, or infringement of foreign substances.

It is still another object of the present invention to provide a photo emission equipment in the main body of the socket stand, which, when being placed in a dark place, where a photo sensor installed thereat can not detect light, a photo emission element starts to emit light and through focusing effect of a light focusing plate disposed on the main body, the brightness of light is intensified such that the user is able to identify the socket position in the dark and facilitate his/her night work.

To achieve these and other objects, the socket stand of the present invention comprises a main body, a ⊓ shaped (inversely U shaped) pull lever, a photo emission equipment with light focusing plate and a conical sustainer. The main body of the socket stand further consists of a front case and a rear case with a groove formed along each bonding side edge of the two cases. A sliding portion at each lower end of the ⊓ shaped pull lever is fitted in the groove and is slidable therein when the two cases are combined with each other. A semi-circular recessed slot having screw threads on its inner surface is formed at the respective bottom of each of the two cases for screw combining with the conical sustainer. A opening is formed at the surface of the rear case for fastening the light focusing plate. A circular hole is provided above the opening for exposedly mounting a photo sensor thereon. The main switch is mounted on another opening formed on the surface of the front case and protected by an insulated transparent cover so as to ensure both water tightness and reliable electrical insulation. The socket is also protected by a shielding cover so that the socket can be shielded at the time it is not in use thereby protecting possible injury to a third person or infringement of foreign substances. The photo emission equipment which including a photo emission element and the above mentioned photo sensor, is located at the back of the surface where the main switch and the sockets are disposed. When the front and the rear cases are fitted with each other, the photo emission element aligns with the light focusing plate mounted on the surface of the rear case thereby intensifying the brightness of light. The conical sustainer is used to fix the socket stand on the ground.

THE BRIEF DESCRIPTION OF THE DRAWINGS

The accompanying drawings, which are included to provide a fuller understanding of the invention and incorporated in and constitute a part of this specification, illustrate the enbodiment of the invention and together with the description serves to explain the principles of the invention, wherein.

Figure 1B:
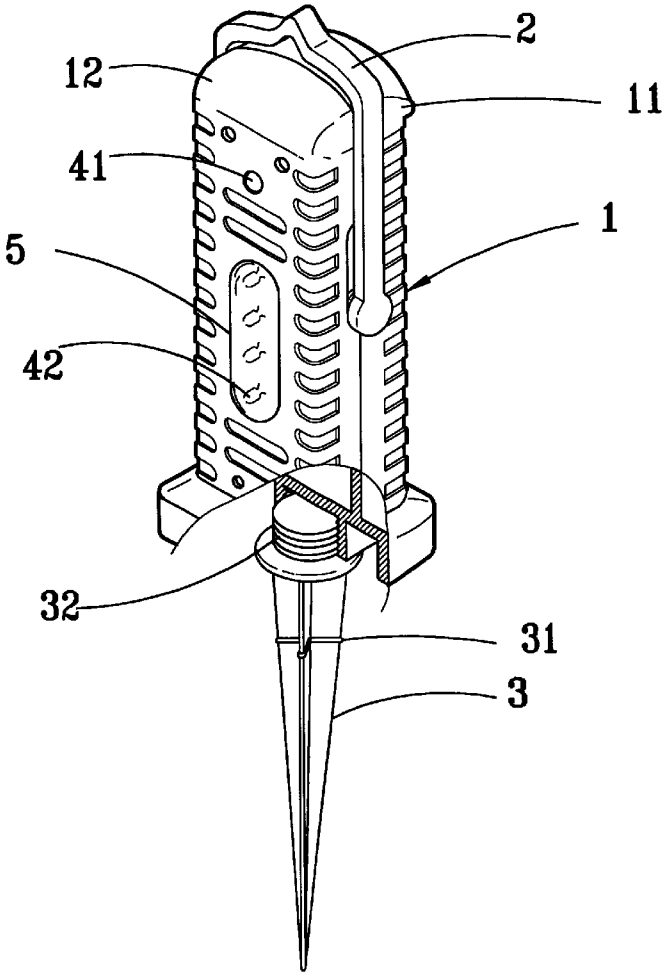
FIGS. 1A and 1B are three dimensional views of a removable socket stand of the present invention.
Figure 1:
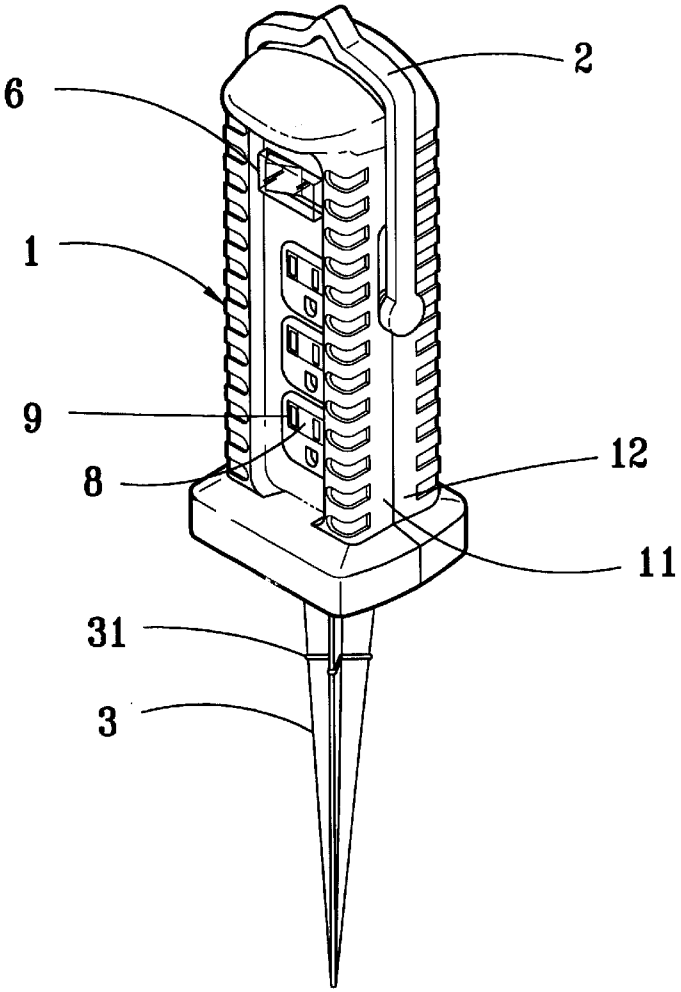
Figure 2:
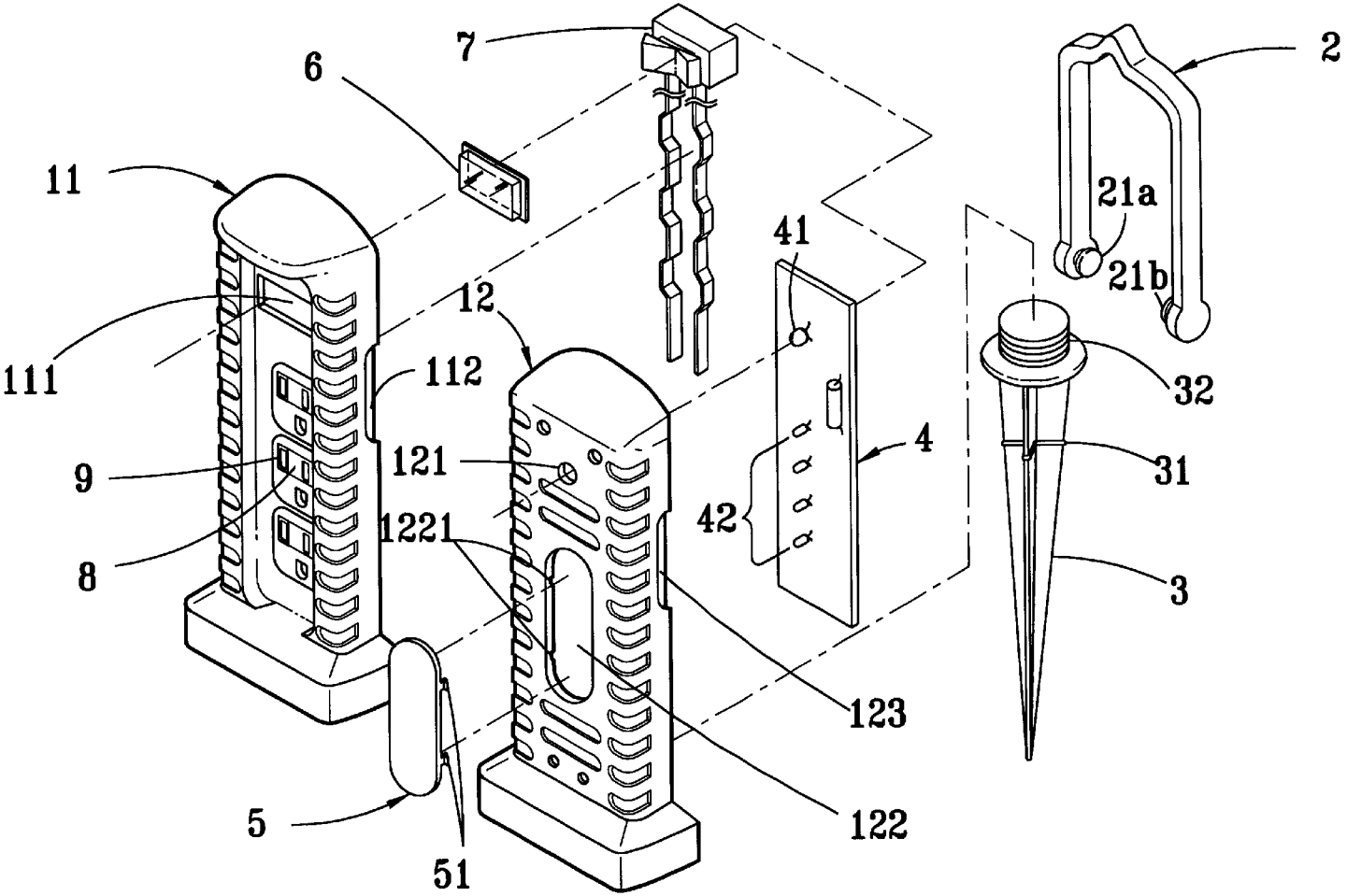
FIG. 2 is an exploded perspective view of the removable socket stand of the present invention.
Figures 3A, 3B:
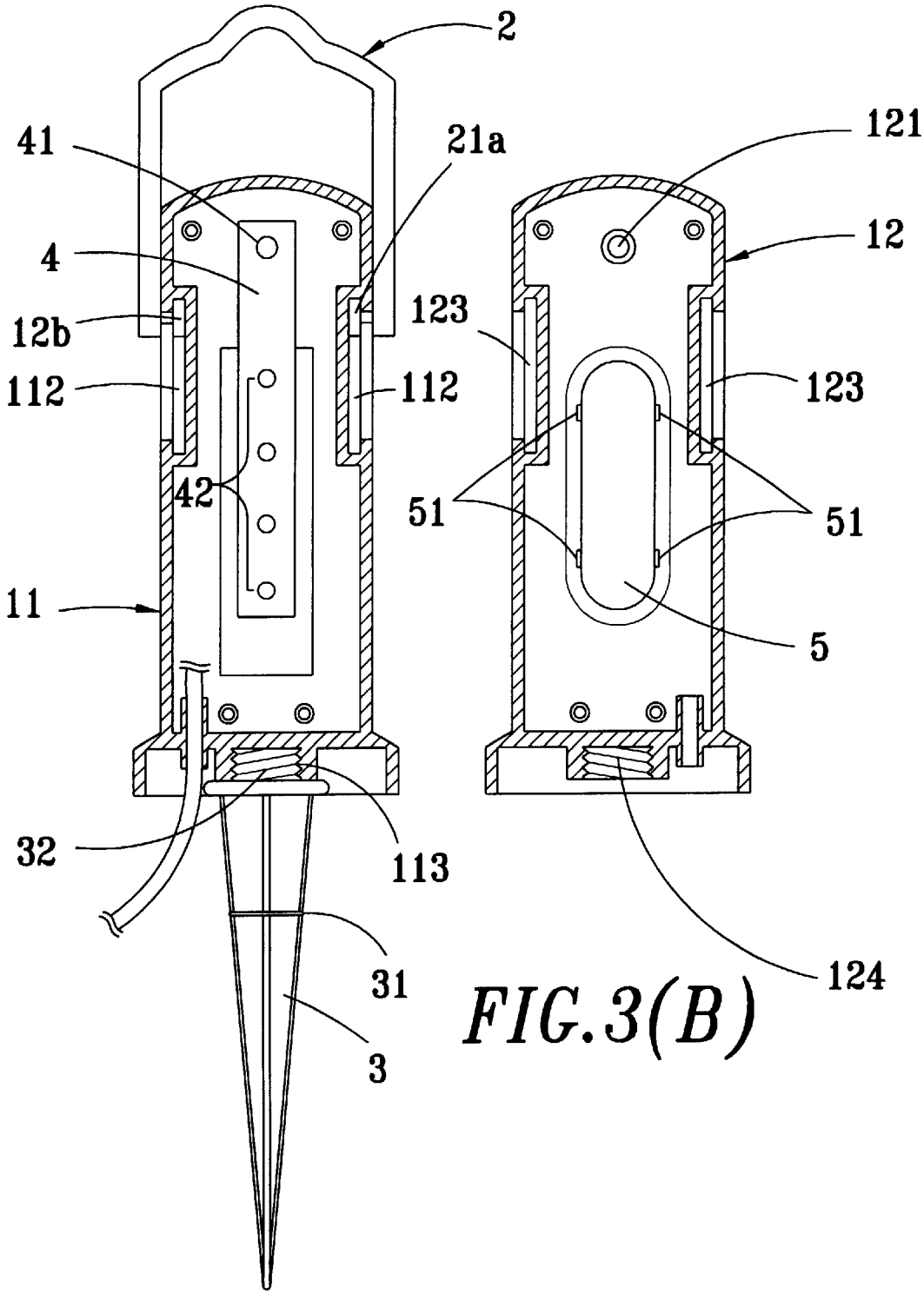
Figure 4B:
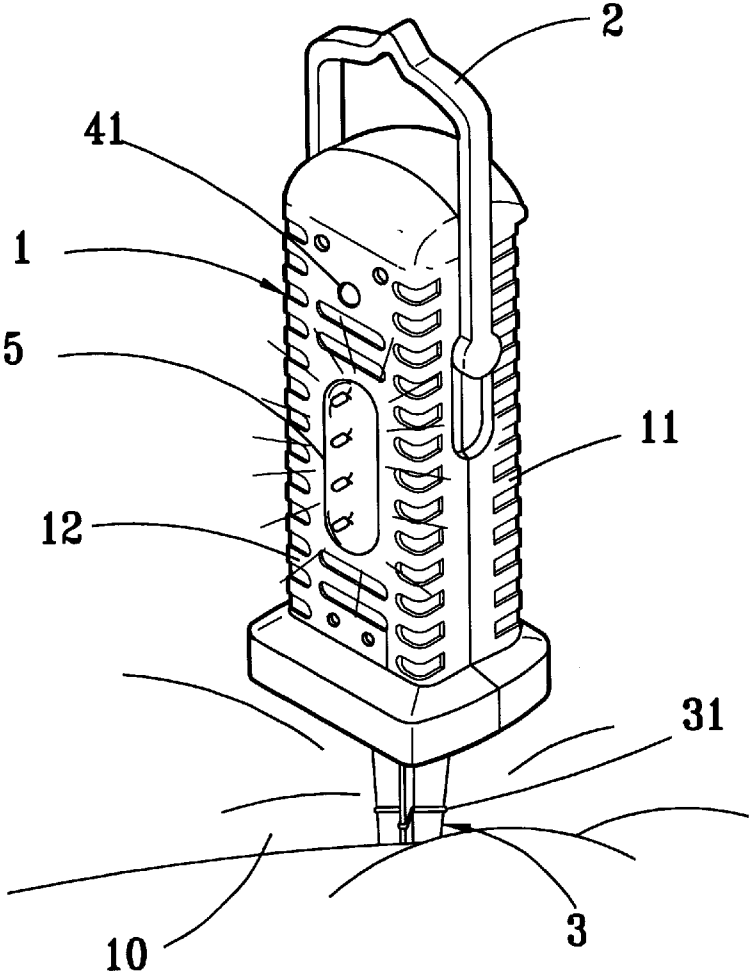
Figure 4A:
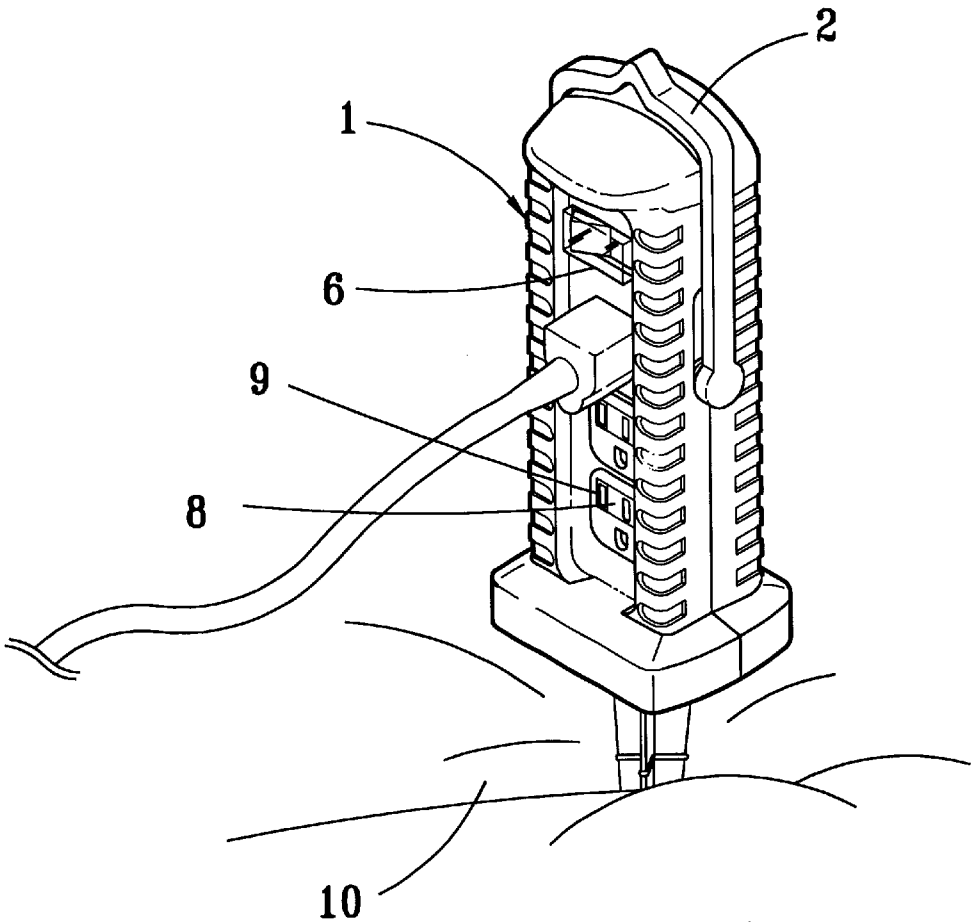

FIGS. 3A and B are illustrative drawing showing the inner construction of the removable socket stand according to the present invention; and FIGS. 4A and B are illustrative drawing showing how the removable socket stand is carried out in an embodiment of the present invention.

DETAILED DESCRIPTION OF THE PREFERRED EMBODIMENT

Hereinafter, the best mode for carrying out the present invention will be described more fully below with reference to attached drawings:

Referring to FIGS. 1A, 1B, FIG. 2 and FIGS. 3A, 3B simultaneously, the socket stand for extension wires for use in outdoor garden and lawn comprises a main body 1 of the socket stand, a ⊓ shaped pull lever 2, a conical sustainer 3, a photo emission equipment 4, a light focusing plate 5, an insulated transparent cover 6, a main switch 7 for power supply, and a shielding cover 8 for individual socket. The main body 1 further includes a front case 11 and a rear case 12 combined together. Semi-circular recessed slots 113, 124 having screw threads on their inner surfaces are formed at the respective bottoms of both the front and the rear cases 11 and 12. Two grooves 112 and 113 are formed along respective bonding side edges of the front and the rear cases 11, 12 for two sliding portions 21*a* and 21*b* at both lower ends of the ⊓ shaped pull lever 2 to slide along. An opening 122 is provided on the surface of the rear case 12 for engaging several stoppers 51 protruded out of the circumference of the light focusing plate 5 with corresponding engaging holes 1221 disposed around the edge of the opening 122 such that the light focusing plate 5 is able to stride thereover and fixed to the rear case 12. The main switch 7 is mounted over another opening 111 formed on the surface of the front case and protected by an insulated transparent cover 6 so as to ensure water tightness and reliable electrical insulation. The socket 9 is also protected by a shielding cover 8 so that the socket 9 can be shielded at the time it is not in use thereby it is protected from possible injury to a third person or infringement of foreign substances. The photo emission equipment 4, which including a photo emission element 41 and a photo sensor 42, is located at the back of the surface where the main switch 7 and the sockets 9 are disposed such that it is accommodated in the main body 1. When the photo emission equipment 4 is located in a dark place so that the senser 41 can not detect light, the photo emission element 42 which belongs to a high intensity LED functions to emit light for illuminating the surrounding. As the front and the rear cases 11 and 12 are combined together, two sliding portions 21*a* and 21*b* at both lower ends of the ⊓ shaped pull lever 2 are able to slide along two grooves 112 and 113 formed at the two sides of the main body 1. When the two cases 11 and 12 are fitted each other, the photo emission element 42 aligns with the light focusing plate 5 mounted on the rear case 12 thereby the brightness of light is intensified. The light focusing plate 5 is made water tight and the sensor 41 exposedly mounted on a circular hole 121 formed on the rear case 2. There are two semi-circular recessed slots 113 and 114 having screw threads on their inner surfaces formed at the respective bottoms of the two cases 1 and 12 joining into a resultant threaded hole for screw combining with an upper threaded portion 32 of the conical sustainer 3 so that the socket stand is able to stand on the ground of lawn or garden by insertion of the conical sustainer 3 thereinto. Meanwhile, a warning mark 31 is provided at a proper height on the conical sustainer 3 to warn the user in the case the conical sustainer 3 is inserted too much into the ground so as to prevent water infringement to the socket stand. As a result, danger of short circuit is eliminated.

FIGS. 4A and 4B are embodiment of the removable socket stand according to the present invention. As shown in FIG. 4, the main body 1 can be made fixedly standing on muddy ground 10 or on lawn with the conical sustainer 3 inserted thereinto such that the main body 1 is isolated from the puddles on the ground and the user's security is assured. In the evening, the surrounding is illuminated by the photo emission element 42, and moreover, brightness is further intensified by the light focusing function of the light focusing plate 5 so as to help the night work. When it is intended to pull out the main body 1 from the ground 10, the user may draw it up by grasping the ⊓ shaped pull lever 2 without directly touching the main body 1 to prevent possible danger.

From the above description, it is understood that with the function of a plurality of attached elements, the ⊓ shaped pull lever, the conical sustainer, the insulated transparent cover on the main switch, the shielding cover for individual socket, the removable socket stand for extension wires of the present invention can successfully protect the user's security from an electric hazard. In addition, the photo emission equipment together with the light focusing plate is able to help performing night work securely and efficiently.

Other embodiments of the present invention will become obvious to those skilled in the art in light of above disclosure. It is of course also understood that the scope of the present invention is not to be limited by the foregoing description, but only by the following claims.

What is claimed is:

1. A removable socket stand for extension wires for use in outdoor garden and lawn comprising:

a main body for the socket stand including a front case and a rear case combined together with two semi-circular recessed slot having screw threads on their inner surfaces formed at the respective bottoms of both said front and said rear cases two grooves are formed along respective bonding side edges of said front and said rear cases, an opening and a circular hole are provided on the surface of said rear case and several engaging holes are disposed at both sides of said opening, another opening is also provided on the surface of said front case for a main switch of said socket stand to be exposedly installed thereon;

a photo emission equipment composed of a photo emission element and a photo sensor;

a pull lever with two sliding portions at both ends thereof to be connected with said grooves formed by said front and said rear cases;

a conical sustainer with a threaded upper portion and a warning mark made at a proper position;

a light focusing plate striding over said opening formed on said rear case with several stoppers protruded out of the circumference of said light focusing plate to engage with corresponding engaging holes disposed around the edge of said opening thereby fixing said light focusing plate at its position;

an insulation cover enclosing said main switch for ensuring water tightness of said main switch;

an shielding cover of the individual socket for protecting said socket when not in use;

when said front and said rear cases are combined together, said sliding portions of said pull lever are slidable along said grooves formed at both sides of said main body, said upper threaded portion is able to screw combine with a threaded hole formed at the bottom of said main body to set said socket stand sustained upright on the ground by inserting said conical sustainer into the ground, said photo emission element is aligned with said light focusing plate on said rear case for further intensifying the brightness of light, while said photo sensor is exposedly disposed on said circular hole provide on said rear case.

2. The removable socket stand of claim 1, wherein said pull lever is u-shaped.

3. The removable socket stand of claim 1, wherein said warning mark on said conical sustainer is for warning the user not to insert said conical sustainer too deeply into the ground thereby preventing infringement of water into said socket resulting in a short circuit.

4. The removable socket stand of claim 1, wherein in addition to intensifying brightness of light, said light focusing plate is made water tight.

5. The removable socket stand of claim 1, wherein said insulated cover is made of a soft transparent material so as to protect the user from directly touching the live parts of said main switch thereby ensuring electrical security.

6. The removable socket stand of claim 1, wherein if said socket stand is places in the dark where said photo sensor detects no light, said photo emission element is able to start emitting light for illuminating surroundings.

7. The removable socket stand of claim 2, wherein said photo emission element is a high intensity light emitting diode.

* * * * *